US011380456B2

(12) United States Patent
Iwamoto et al.

(10) Patent No.: US 11,380,456 B2
(45) Date of Patent: Jul. 5, 2022

(54) ELECTROMAGNETIC FIELD CONTROL MEMBER

(71) Applicant: KYOCERA Corporation, Kyoto (JP)

(72) Inventors: Kouichi Iwamoto, Omihachiman (JP); Atsushi Sasagawa, Hikone (JP); Takaya Yokoyama, Konan (JP); Atsushi Yokoyama, Shiga (JP)

(73) Assignee: KYOCERA Corporation, Kyoto (JP)

( * ) Notice: Subject to any disclaimer, the term of this patent is extended or adjusted under 35 U.S.C. 154(b) by 504 days.

(21) Appl. No.: 16/497,281

(22) PCT Filed: Mar. 26, 2018

(86) PCT No.: PCT/JP2018/012047
§ 371 (c)(1),
(2) Date: Sep. 24, 2019

(87) PCT Pub. No.: WO2018/174298
PCT Pub. Date: Sep. 27, 2018

(65) Prior Publication Data

US 2020/0105433 A1 Apr. 2, 2020

(30) Foreign Application Priority Data

Mar. 24, 2017 (JP) ..... JP2017-059274

(51) Int. Cl.
*G21K 1/093* (2006.01)
*H05H 13/00* (2006.01)

(52) U.S. Cl.
CPC ..... *G21K 1/093* (2013.01); *H05H 13/00* (2013.01)

(58) Field of Classification Search
CPC ..... G21K 1/093; H05H 13/00; H05H 13/04; H05H 7/04; H05H 7/10; H05H 2007/046
See application file for complete search history.

(56) References Cited

FOREIGN PATENT DOCUMENTS

WO WO-2022014685 A1 * 1/2022

OTHER PUBLICATIONS

Mitsuda et al, Development of the Ceramics Chamber Integrated Pulsed-Magnet, Takumi Project, Synchrotron Radiation Research Institute, Research Project Achievement Report for 2012, 2013 and 2014, published Aug. 12, 2015, http://www.jasri.jp/development-search/projects/takumi_report.html), 44 pages.

* cited by examiner

*Primary Examiner* — Jurie Yun
(74) *Attorney, Agent, or Firm* — Procopio Cory Hargreaves and Savitch LLP

(57) ABSTRACT

An electromagnetic field control member includes an insulating member constituted of a cylindrical ceramic and having a plurality of through holes along an axial direction, a conductive member constituted of metal and closing the through holes so as to provide an opening that opens in an outer periphery of the insulating member, and a power supply terminal connected to the conductive member. The power supply terminal is located away from an inner wall of the insulating member forming the through holes, and has a first end and a second end in the axial direction, and at least one of the first end and the second end is located farther away from the inner wall than a central portion of the power supply terminal.

20 Claims, 2 Drawing Sheets

ELECTROMAGNETIC FIELD CONTROL MEMBER

TECHNICAL FIELD

The present disclosure relates to an electromagnetic field control member.

BACKGROUND ART

Conventionally, an electromagnetic field control member used in an accelerator for accelerating charged particles such as electrons and baryons is required to have high speed, high magnetic field output and high repeatability. With respect to improvement of these performances, Chikaori Mitsuda et al. of SPring-8 have proposed a ceramic chamber integrated pulsed-magnet (hereinafter referred to as CCIPM).

RELATED ART DOCUMENT

Non-Patent Document

Non Patent Document 1: Chikaori Mitsuda and 5 others, Development of the Ceramic Chamber Integrated Pulsed-Magnet (Takumi Project Research Project, Research Project Achievement Report http://www.jasri.jp/development-search/projects/takumi_report.html)

SUMMARY OF THE INVENTION

An electromagnetic field control member of the present disclosure includes an insulating member constituted of a cylindrical ceramic and having a plurality of through holes along an axial direction, a conductive member constituted of metal and closing the through holes so as to provide an opening that opens in an outer periphery of the insulating member, and a power supply terminal connected to the conductive member. The power supply terminal is located away from an inner wall of the through hole, and has a first end and a second end in the axial direction, and at least one of the first end and the second end is located farther away from the inner wall than a central portion of the power supply terminal.

EMBODIMENTS FOR CARRYING OUT THE INVENTION

Hereinafter, an example of an embodiment of an electromagnetic field control member of the present disclosure will be described with reference to the drawings. FIGS. 1(*a*) to 1(*d*) show an example of an electromagnetic field control member of the present embodiment, in which FIG. 1(*a*) is a perspective view, FIG. 1(*b*) is an enlarged view of a portion A in FIG. 1(*a*), FIG. 1(*c*) is an enlarged view of a portion B in FIG. 1(*a*), and FIG. 1(*d*) is a schematic diagram explaining a configuration of a power supply terminal.

Figure 1A:
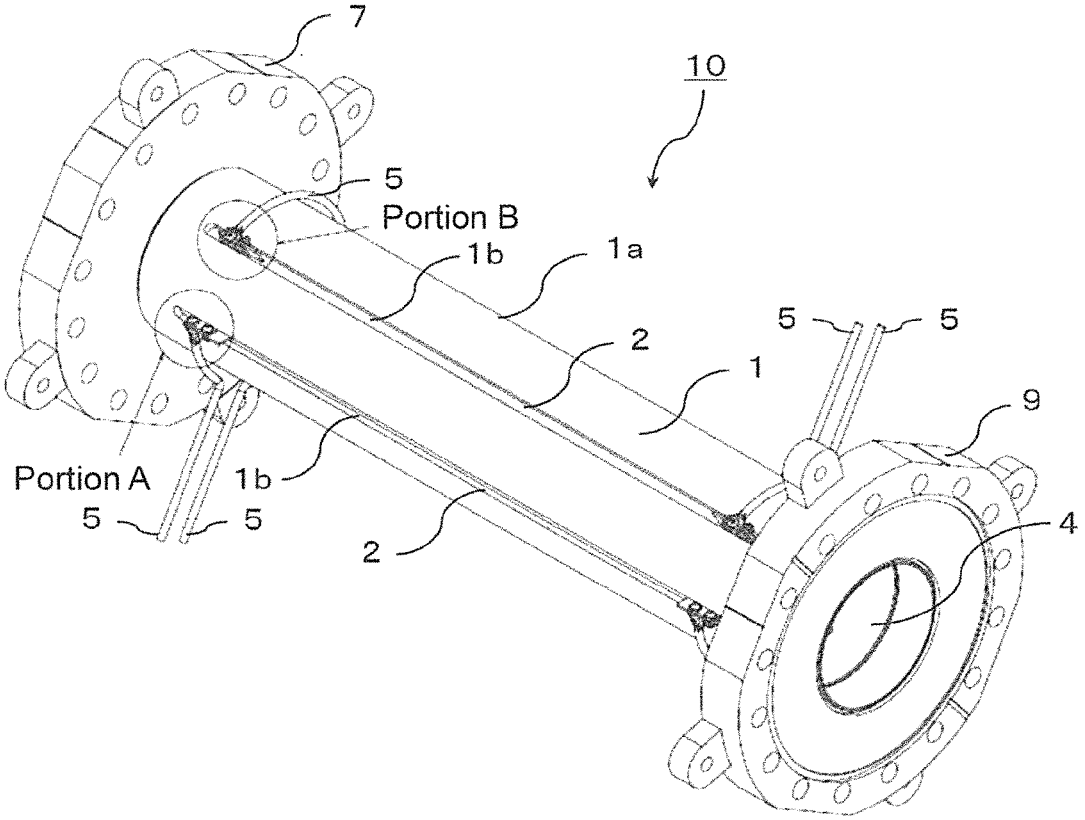
FIGS. 1(*a*) to 1(*d*) show an example of an electromagnetic field control member of the present embodiment, in which FIG. 1(*a*) is a perspective view, FIG. 1(*b*) is an enlarged view of a portion A in FIG. 1(*a*), FIG. 1(*c*) is an enlarged view of a portion B in FIG. 1(*a*), and FIG. 1(*d*) is a schematic diagram explaining a configuration of a power supply terminal.
Figure 1B:
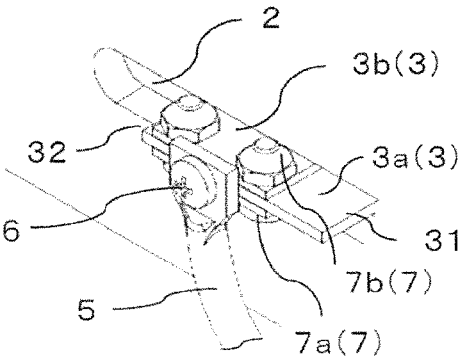
Figure 1C:
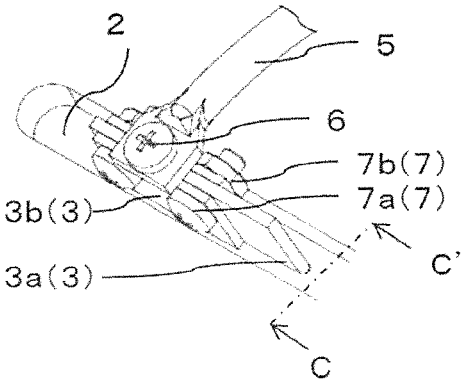
Figure 1D:
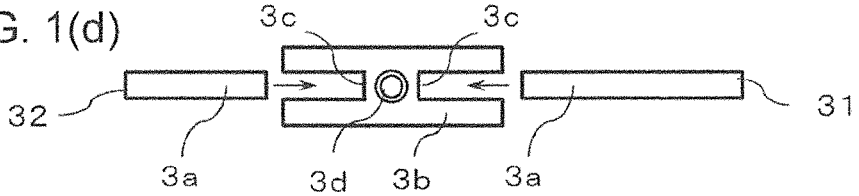
Figure 2A:
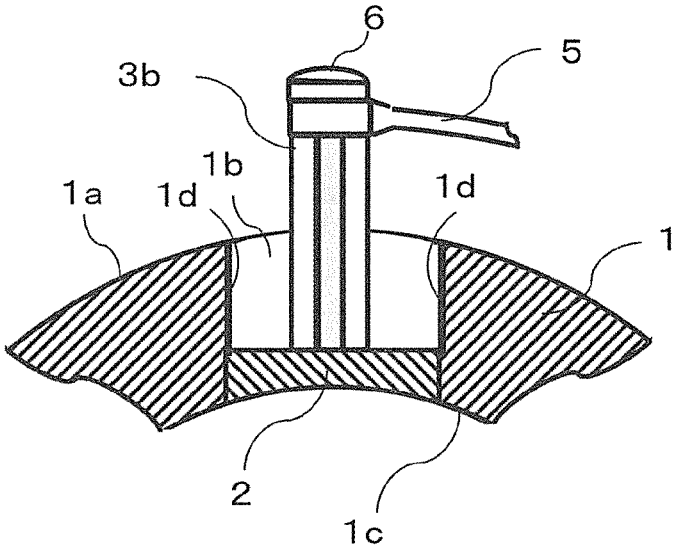
FIGS. 2(*a*) and 2(*b*) are each a cross-sectional view taken along a line C-C' of FIG. 1(*c*), in which FIG. 2(*a*) is an example, and FIG. 2(*b*) is another example.
Figure 2B:
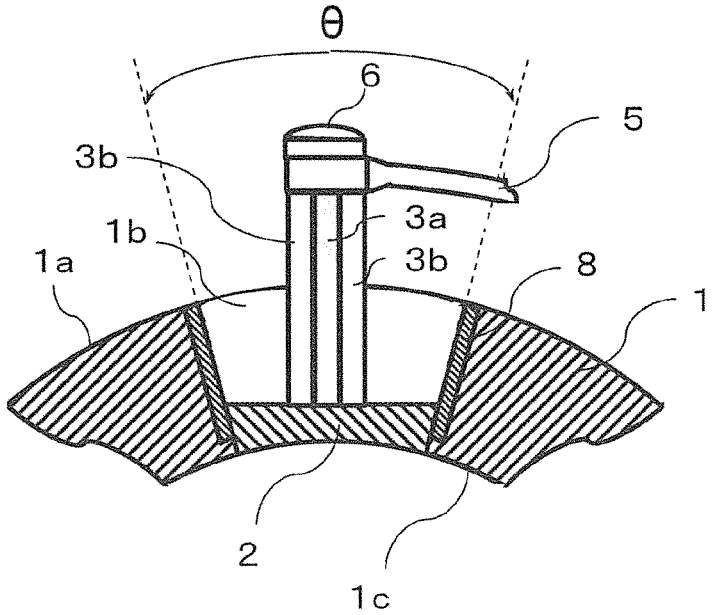

Further, FIGS. 2(*a*) and 2(*b*) are each a cross-sectional view taken along a line c-c' of FIG. 1(*c*), in which FIG. 2(*a*) is an example, and FIG. 2(*b*) is another example. In addition, in FIGS. 2(*a*) and 2(*b*), one of members which constitute a power supply terminal is indicated by coloring for identification.

In this example, an example of the CCIPM (ceramic chamber integrated pulsed-magnet) will be described as an embodiment of the electromagnetic field control member. The CCIPM of this example includes an insulating member constituted of a cylindrical ceramic and having a plurality of through holes along an axial direction, and a conductive member constituted of metal and closing the through holes so as to provide an opening that opens in an outer periphery of the insulating member. Airtightness of the space enclosed by an inner periphery of the insulating member is ensured by the conductive member closing the through holes.

An electromagnetic field control member 10 shown in FIG. 1(*a*) includes an insulating member 1 constituted of a cylindrical ceramic, a conductive member 2 constituted of metal and extending along an axial direction, and power supply terminals 3 connected to the conductive member 2. Note that the axial direction is a central axial direction of the insulating member 1 constituted of a cylindrical ceramic. In the present embodiment, the insulating member 1 is cylindrical. Then, the insulating member 1 has a plurality of through holes along the axial direction before the conductive member 2 is disposed. Further, the conductive member 2 is located in a through hole of the insulating member 1 and closes the through hole so as to provide an opening 1*b* opened in an outer periphery 1*a* of the insulating member 1.

The conductive member 2 and the power supply terminals 3 are then connected by brazing using a brazing material. Further, a power supply terminal 3 has a first end 31 and a second end 32 along the axial direction. Here, the first end 31 is one end in a direction along the axial direction, and the second end 32 is the other end in the direction along the axial direction. Therefore, the first end 31 and the second end 32 are farthest apart in the power supply terminal 3.

The insulating member 1 has an electric insulation property and non-magnetism, and constituted of, for example, an aluminum oxide ceramic or a zirconium oxide ceramic.

In addition, the aluminum oxide ceramic is a ceramic whose content of aluminum oxide obtained by converting Al into $Al_2O_3$ is 90 mass % or more among 100 mass % of all the components constituting the ceramic.

Moreover, the zirconium oxide ceramic is a ceramic whose content of zirconium oxide obtained by converting Zr into $ZrO_2$ is 90 mass % or more among 100 mass % of all the components constituting the ceramic.

As the size of the insulating member 1, for example, an outer diameter is set to 35 mm or more and 45 mm or less, an inner diameter is set to 25 mm or more and 35 mm or less, and an axial length is set to 380 mm or more and 420 mm or less.

Since a space 4 located inside the insulating member 1 is for accelerating or deflecting electrons, baryons, and the like moving in the space 4 by a high frequency or pulsed electromagnetic field, it is necessary to maintain a vacuum. Note that a flange 9 shown in FIG. 1(*a*) is a member connected to a vacuum pump for evacuating the space 4.

The conductive member 2 ensures a conductive area for allowing an induced current to flow that is excited to accelerate or deflect electrons, baryons, and the like which move in the space 4. The conductive member 2 is preferably along an inner periphery 1$c$ of the insulating member 1 as shown in FIGS. 2($a$) and 2($b$).

The power supply terminals 3 are each joined by a brazing material such as silver brazing (for example, BAg-8) near both ends of the conductive member 2. Then, electricity is supplied to the power supply terminal 3 through electrical transmission members 5. The electrical transmission members 5 are fixed by being screwed into respective screw holes 3$d$ of the power supply terminals 3 with screws 6.

The conductive member 2, the power supply terminal 3, and the electrical transmission member 5 are constituted of, for example, copper. Among coppers, an oxygen-free copper is preferred from the viewpoint of electrical resistance.

It is necessary to connect the power supply terminals 3 to the conductive members 2 in order to supply power. For connection of the power supply terminals 3, bonding by brazing is employed.

In a conventional electromagnetic field control member, in this brazing, a brazing material may bulge on a surface of a power supply terminal which is a member to be joined, and accumulation of the brazing material may occur in contact with an inner wall of a through hole of an insulating member. The accumulation of the brazing material on the inner wall repeatedly expands and shrinks when heating and cooling are repeated in use, and the expansion and shrinkage may cause the inner wall of the insulating member to crack. In the electromagnetic field control member, a space located inside the insulating member is a space for accelerating or deflecting electrons, baryons, and the like moving in the space by a high frequency or pulsed electromagnetic field, and needs to be kept in vacuum. In the conventional electromagnetic field control member, there is a possibility that airtightness of the space located inside the insulating member decreases by occurrence of the crack caused by accumulation of brazing material in the insulating member.

The power supply terminal 3 in the electromagnetic field control member 10 of the present embodiment is located away from an inner wall 1$d$ of the through hole, and at least one of the first end 31 and the second end 32 is located farther away from the inner wall 1$d$ than a central portion of the power supply terminal 3. In addition, it can be reworded that at least one of the first end 31 and the second end 32 is narrower or thinner than the central portion of the power supply terminal 3. Since the electromagnetic field control member 10 of the present embodiment satisfies such a configuration, the brazing material does not easily bulge on the surface of the power supply terminal 3, which is a member to be joined, at the time of brazing. Thus, there is little possibility of accumulation of the brazing material to be in contact with the inner wall 1$d$ of the through hole of the insulating member 1. Therefore, in the electromagnetic field control member 10 of the present embodiment, a crack does not easily occur in the inner wall 1$d$ forming the through hole of the insulating member 1 even if heating and cooling are repeated in use. Therefore, the airtightness of the space 4 located inside the insulating member 1 can be maintained for a long time.

Note that regarding the central portion in the power supply terminal 3, for example, when the power supply terminal 3 is constituted of an end member 3$a$ and a central member 3$b$ as shown in FIG. 1($d$), the central member 3$b$ corresponds to the central portion. When the power supply terminal 3 is integrally formed and the distance between the first end 31 and the second end 32 is regarded as a length, a portion corresponding to the center obtained by equally dividing the length by 5 is set as the central portion. Further, being located away from the inner wall 1$d$ may be judged by comparison with the distance to the inner wall 1$d$.

For example, the distance between the inner walls 1$d$, in other words, a width of the opening 1$b$ is set to 4 mm or more and 6 mm or less, a width (thickness) of at least one of the first end 31 and the second end 32 is set to 0.5 mm or more and 1.5 mm or less, and a width of the central portion is set to 2 mm or more and 3 mm or less.

Further, as shown in FIG. 1($c$), in the power supply terminal 3, both ends of the first end 31 and the second end 32 may be located farther away from the inner wall 1$d$ than the central portion of the power supply terminal 3.

The power supply terminal 3 may include an end member 3$a$ including a first end 31 or a second end 32, and a central member 3$b$ including a central portion, in which the end member 3$a$ and the central member 3$b$ are fitted to each other. An example of the above configuration is shown in FIG. 1($d$).

In FIG. 1($d$), the power supply terminal 3 is constituted of a plurality of end members 3$a$ in a plate shape and a central member 3$b$ having recesses 3$c$. Then, by fitting the end members 3$a$ into the recesses 3$c$ of the central member 3$b$, the power supply terminal 3 can be obtained. In addition, a divided structure in the power supply terminal 3 is not limited to the configuration of FIG. 1($d$). For example, the end member 3$a$ may have an isosceles trapezoid shape whose width decreases toward a tip in plan view.

Note that dimensions of the end members 3$a$ and the central member 3$b$ can be selected according to the distance between the inner walls 1$d$, in other words, the width of the opening 1$b$.

Then, in the configuration shown in FIG. 1($d$), the end member 3$a$ and the central member 3$b$ can be fastened by using a bolt 7$a$ and a nut 7$b$ to the holes which are overlapped by fitting. In addition, the fastening method is not limited to the above description.

Further, the power supply terminal 3 may be such that at least a part thereof protrudes in a radial direction from the outer periphery 1$a$ of the insulating member 1. When such a configuration is satisfied, the volume of the power supply terminal 3 increases. Thus, a large current can be applied to the power supply terminal 3, and electrons, baryons, and the like moving in the space 4 can be efficiently accelerated or deflected.

Moreover, in the electromagnetic field control member 10, as shown in FIG. 2($a$), a metalized layer 8 may be provided on the inner wall 1$d$. When the metalized layer 8 is thus provided on the inner wall 1$d$, the brazing material does not come in direct contact with the insulating member 1, and thus a crack in the insulating member 1 can be further suppressed. In addition, the metalized layer 8 may be located between the insulating member 1 and the conductive member 2. When the metalized layer 8 is located between the insulating member 1 and the conductive member 2, an end of the metalized layer 8 located near the inner periphery 1$c$ may be located in a region where the insulating member 1 and the conductive member 2 oppose each other.

Examples of the metalized layer 8 include one containing molybdenum as a main component and containing manganese. Further, a metal layer containing nickel as a main component may be provided on the surface of the metalized layer 8.

In addition, the through hole may have a width between the inner walls 1$d$ that gradually increases from the inner periphery 1$c$ to the outer periphery 1$a$ of the insulating member 1, that is, a tapered surface. When such a configuration is satisfied, stress remaining in the insulating member 1 is alleviated, and thus a crack in the insulating member 1 can be suppressed over a long period of time.

Then, when the through hole has a tapered surface, an angle θ which the opposing inner walls 1*d* form may be 12° or more and 20° or less. When the taper angle θ is in this range, the mechanical strength of the insulating member 1 can be maintained, and a crack in the insulating member 1 can be further suppressed. In addition, upon measurement of the angle which the opposing inner walls 1*d* form, it is sufficient to measure the angle in a cross section orthogonal to the axial direction, as shown in FIG. 2(*b*).

Next, an example of a method of manufacturing the electromagnetic field control member of the present embodiment will be described.

First, an insulating member made of a cylindrical ceramic and having a plurality of through holes along the axial direction is prepared. At this time, a metalized layer or a metal layer may be provided in advance on inner walls of the insulating member. Further, the inner walls may be tapered surfaces that a width between the inner walls gradually increases from an inner periphery toward an outer periphery. Furthermore, the angle θ between the opposing inner walls may be 12° or more and 20° or less.

Further, a rod-like conductive member constituted of metal is prepared. Then, after the conductive member is inserted into a through hole of the insulating member, the through hole of the insulating member is closed by joining the insulating member and the conductive member using a brazing material such as silver solder (for example, BAg-8).

Next, a power supply terminal is disposed on the conductive member, and the power supply terminal is joined to the conductive member by the brazing material.

At this time, since at least one of the first end and the second end of the power supply terminal is located farther away from the inner wall than the central portion of the power supply terminal, the brazing material does not easily bulge at the time of brazing. Thus, there is little possibility of accumulation of the brazing material to be in contact with the inner wall of the insulating member. In addition, when a power supply terminal consists of a plurality of end members in a plate shape and a central member having recesses, the central member may be fastened after the end members are joined first, or the end members and the central member may be joined after fastening with each other.

In the electromagnetic field control member obtained by the above-described manufacturing method, a crack does not easily occur in the inner walls of the insulating member even if heating and cooling are repeated in use. Therefore, airtightness of the space located inside the insulating member can be maintained for a long time.

DESCRIPTION OF THE REFERENCE NUMERAL

1: Insulating member
1*a*: Outer periphery
1*b*: Opening
1*c*: Inner periphery
1*d*: Inner wall
2: Conductive member
3: Power supply terminal
4: Space
5: Electrical transmission member
6: Screw
7: Fastening member
7*a*: Bolt
7*b*: Nut
8: Metalized layer
9: Flange
10: Electromagnetic field control member

The invention claimed is:

1. An electromagnetic field control member comprising:
a cylindrical ceramic insulating member having a plurality of through-holes along an axial direction;
a metal conductive member closing each of the plurality of through-holes so as to provide an opening that opens in an outer periphery of the insulating member; and
a power supply terminal connected to the conductive member,
located away from an inner wall of the insulating member forming the plurality of through-holes, and having a first end and a second end in the axial direction,
wherein at least one of the first end and the second end is located farther away from the inner wall than a central portion of the power supply terminal.

2. The electromagnetic field control member according to claim 1, wherein the power supply terminal comprises an end member including the first end or the second end, and a central member including the central portion.

3. The electromagnetic field control member according to claim 2, wherein the end member and the central member are fitted to each other.

4. The electromagnetic field control member according to claim 3, wherein at least a part of the power supply terminal protrudes in a radial direction from an outer periphery of the insulating member.

5. The electromagnetic field control member according to claim 3, wherein a metalized layer is provided on the inner wall.

6. The electromagnetic field control member according to claim 3, wherein a width between inner walls gradually increases from the inner periphery to the outer periphery of the insulating member.

7. The electromagnetic field control member according to claim 6, wherein in a cross section perpendicular to the axial direction, an angle formed by the inner walls opposing each other is 12° to 20°.

8. The electromagnetic field control member according to claim 2, wherein at least a part of the power supply terminal protrudes in a radial direction from an outer periphery of the insulating member.

9. The electromagnetic field control member according to claim 2, wherein a metalized layer is provided on the inner wall.

10. The electromagnetic field control member according to claim 2, wherein a width between inner walls gradually increases from the inner periphery to the outer periphery of the insulating member.

11. The electromagnetic field control member according to claim 10, wherein in a cross section perpendicular to the axial direction, an angle formed by the inner walls opposing each other is 12° to 20°.

12. The electromagnetic field control member according to claim 1, wherein at least a part of the power supply terminal protrudes in a radial direction from an outer periphery of the insulating member.

13. The electromagnetic field control member according to claim 12, wherein a metalized layer is provided on the inner wall.

14. The electromagnetic field control member according to claim 12, wherein a width between inner walls gradually increases from the inner periphery to the outer periphery of the insulating member.

15. The electromagnetic field control member according to claim 14, wherein in a cross section perpendicular to the axial direction, an angle formed by the inner walls opposing each other is 12° to 20°.

16. The electromagnetic field control member according to claim 1, wherein a metalized layer is provided on the inner wall.

17. The electromagnetic field control member according to claim 16, wherein a width between inner walls gradually increases from the inner periphery to the outer periphery of the insulating member.

18. The electromagnetic field control member according to claim 17, wherein in a cross section perpendicular to the axial direction, an angle formed by the inner walls opposing each other is 12° to 20°.

19. The electromagnetic field control member according to claim 1, wherein a width between inner walls gradually increases from the inner periphery to the outer periphery of the insulating member.

20. The electromagnetic field control member according to claim 19, wherein in a cross section perpendicular to the axial direction, an angle formed by the inner walls opposing each other is 12° to 20°.

* * * * *